US009914512B2

(12) United States Patent
Said

(10) Patent No.: US 9,914,512 B2
(45) Date of Patent: Mar. 13, 2018

(54) HUMAN THERMAL WARMING SUITS FOR WET SUBMERSIBLES

(71) Applicant: LOCKHEED MARTIN CORPORATION, Bethesda, MD (US)

(72) Inventor: Brian R. Said, Jupiter, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 12 days.

(21) Appl. No.: 14/803,521

(22) Filed: Jul. 20, 2015

(65) Prior Publication Data

US 2017/0021902 A1 Jan. 26, 2017

(51) Int. Cl.

| | |
|---|---|
| ***B63C 11/04*** | (2006.01) |
| ***B63C 11/18*** | (2006.01) |
| ***B63C 11/28*** | (2006.01) |
| ***B63G 8/00*** | (2006.01) |
| ***B63C 11/46*** | (2006.01) |

(52) U.S. Cl.

CPC ..... *B63C 11/18* (2013.01); *B63C 11/04* (2013.01); *B63C 11/28* (2013.01); *B63C 11/46* (2013.01); *B63G 8/00* (2013.01)

(58) Field of Classification Search

CPC ... B63C 11/46; B63C 11/04; B63C 2011/043; B63C 2011/046; B63C 11/06; B63C 11/10; B63C 11/08

See application file for complete search history.

(56) References Cited

U.S. PATENT DOCUMENTS

| | | | | |
|---|---|---|---|---|
| 2,544,840 A * | 3/1951 | Kowatsch | ..... | A41D 27/208 2/252 |
| 2,593,988 A * | 4/1952 | Cousteau | ..... | B63C 11/08 128/201.27 |
| 4,014,384 A * | 3/1977 | Marcus | ..... | B63C 11/28 126/400 |
| 4,464,795 A * | 8/1984 | Long | ..... | B63C 11/04 2/2.17 |
| 4,820,084 A | 4/1989 | Dahlback | | |
| 5,100,261 A | 3/1992 | Plemon | | |

(Continued)

FOREIGN PATENT DOCUMENTS

| | | | | |
|---|---|---|---|---|
| GB | 191321479 A * | 0/1915 | ..... | B63C 11/08 |
| JP | 2000302091 | 10/2000 | | |

OTHER PUBLICATIONS

International Search Report and Written Opinion for PCT/US2016/042504, dated Oct. 18, 2016 (14 pages).

*Primary Examiner* — Andrew Polay
(74) *Attorney, Agent, or Firm* — Hamre, Schumann, Mueller & Larson, P.C.

(57) ABSTRACT

Thermal warming suits for a human occupant of a wet submersible vehicle are described. The thermal warming suits provide a dedicated envelope configured to encase at least a portion of the human occupant in a deformable suit that can be assembled around or donned, as well as be removed, by the occupant or others before or after entry and seating in or on the wet submersible vehicle, while underwater or surfaced. The suits provide a deformable, weight and space (i.e. volume) conscious, collapsible loose fitting perimeter around the occupant. The suits can be used to create a pneumatic barrier around at least a portion of the occupant by using a gas such as air provided from a gas reservoir to force water from the interior of the suit.

17 Claims, 8 Drawing Sheets

(56) References Cited

U.S. PATENT DOCUMENTS

| | | | | |
|---|---|---|---|---|
| 7,004,099 | B2 * | 2/2006 | Iijima | B63C 11/46<br>114/242 |
| 2005/0223962 | A1 | 10/2005 | Sueshige et al. | |
| 2012/0220175 | A1 | 8/2012 | Bertrand | |

* cited by examiner

HUMAN THERMAL WARMING SUITS FOR WET SUBMERSIBLES

FIELD

This disclosure relates to wet manned submersible vehicles and to systems for providing thermal control and water management about a human occupant or rider of wet manned submersible vehicles as well as providing thermal control and water management about a human in other underwater applications.

BACKGROUND

When riding a wet manned submersible vehicle, a human occupant may be exposed to long duration submersions in water that is at temperatures that may be below normal human comfort, and perhaps even survival, levels potentially leading to hypothermia. This can create significant energy drain and fatigue on the human occupant caused by core thermal cooling processes that result from the human body's response to maintain thermal equilibrium while exposed to such temperatures and rapid exothermic heat loss due to water thermal film coefficients. The result after such exposure can be a drastic reduction in human physical and intellectual performance. In the case of military personnel, at the end of a transit excursion on a wet submersible, this reduction in physical and intellectual performance may occur at the exact time when maximum exertion and optimal decision-making is required.

Currently, underwater thermal protection is provided by wet suits, dry suits, circulatory hot water hydronic heating, and electric heating. The most energy efficient solution is a dry suit that can be worn by the human occupant of the wet submersible vehicle. However a dry suit does not provide the volume or space for an individual of average dexterity to withdraw their hands and arms from the sleeve and glove area of the suit into a main core zone of the dry suit in such a way as to provide tactile access of the wearer to certain dry zones (for example, head, neck, shoulders, torso) with his/her own hands. Further, a dry suit requires open circuit buoyancy, i.e. inflation/pressurization, control by the individual wearing the dry suit. However, variations in the dry suit buoyancy affect the individual's buoyancy and therefore affect the overall buoyancy of the wet submersible vehicle. In addition, air is expelled from the dry suit's dump valve as the buoyancy is adjusted during venting procedures such as during an ascent of the wet submersible vehicle. As expelled air ascends to the water surface it expands due to the decreasing pressure differential, creating a tell-tale eruption of bubbles at the water surface which, in the case of military operations, can undesirably signal the presence of military personnel below.

SUMMARY

Thermal warming suits for a human user operating submerged in water are described. The thermal warming suits described herein provide a dedicated envelope configured to encase at least a portion of the user in a deformable, flexible suit that can be assembled around or donned, as well as be removed, by the user while the user is submerged underwater or at the surface. The suits described herein provide a deformable, weight and space (i.e. volume) conscious, collapsible loose fitting perimeter around the user. The suits can be used to create a pneumatic barrier around at least a portion of the user by using a gas such as air provided from a gas reservoir to force water from the interior of the suit.

The barrier can be achieved with very low stored power or manual power, and can utilize a re-useable gas, such as air, from a reservoir. Because the gas is re-useable, the gas does not require regeneration. In addition, the suit provides silent or near-silent operation, there is no expelled gas that is prone to observation resulting from a tell-tale eruption of bubbles at the water surface. The space created by the suit further facilitates nutrient intake and excrement by the occupant utilizing conventional means, without special additional apparatus.

The suits described herein can be worn by a human user that is submerged underwater in any application. In one specific, non-limiting application, the suit can be worn by an occupant or rider of a wet submersible vehicle. In such an application, the user can don the suit before or after entry and seating in or on the wet submersible vehicle. However, other applications of the suit are possible The suits described herein eliminate high heat loss from the user by enveloping defined areas or body parts of the user in air or other gas to isolate those areas from surrounding water by a pneumatic barrier or envelope. The gas in the interior of the suit is heated by the user's body heat and/or the gas can be heated by a suitable electro-mechanical heating device during or prior to the gas being introduced into the suit. In one embodiment, the suits are configured so that at least the occupant's head and neck are enveloped in a single common or contiguous pneumatic barrier. In another embodiment, the user's chest, lower abdomen, waist, upper thighs, shoulders, arms and hands can also be enveloped. In still another embodiment, the entirety of the occupant's thighs and the occupant's knees can also be enveloped. In still another embodiment, the occupant's lower legs and feet can also be enveloped. The suits described herein can be configured so that any desired portions of the human body can be enveloped by the pneumatic barrier.

In one embodiment, the pneumatic barrier formed by the suit will be large enough to permit the user to use their hands to reach into the interior space of the suit to access their own body. For example, the suit can be configured to permit the user to retract their arms, hands, legs, feet and/or head into the interior space of the suit to permit the user to access areas of his body using the user's hands that can maneuver within the suit. The suit can also include arm, hand and head protuberances to allow the user to access and control equipment and perform activities external to the suit.

In one embodiment, when the suit is used by an occupant or rider of a wet submersible vehicle, the suit can comprise an individual flexible waterproof hermetic envelope that may be stowed on the vehicle near the location of the occupant or rider prior to use, and that can be unfolded and pulled over the top of, or fastened about the occupant and, in some embodiments also fastened to the vehicle if the suit is not already fastened to the vehicle, while the vehicle is at the water surface or submerged underwater. Once donned by the occupant, the upper end of the suit is completely sealed, and the lower extremity of the suit is open to the surrounding water environment to allow water to be displaced from the interior of the suit out the lower end of the suit by a gas as the gas is pumped into the suit. A reservoir of gas including, but not limited to, air, nitrogen, or argon, is accommodated within the vehicle and is fluidly connected to the suit. The gas reservoir is also open to the surrounding water environment via one or more openings located below the lowermost anticipated gas/water interface in the reservoir so that the gas reservoir is water-floodable and the gas cannot escape from the reservoir through the opening(s). A motorized or manual pump can be provided for pumping gas between the reservoir and the suit. As the gas is introduced from the gas reservoir into the suit, water is displaced out of the suit, and at the same time a corresponding amount of water enters into the gas reservoir. Likewise, as the gas is transferred from the suit into the gas reservoir, the gas forces water from the gas reservoir and a corresponding amount of water enters into the interior of the suit. Therefore, for a given depth, the total volume of gas in the gas reservoir and the interior of the suit remains the same so that the total buoyancy acting on the wet submersible vehicle does not change.

In one embodiment, a system described herein includes a wet submersible vehicle and a suit that is configured to be worn by a human occupant of the wet submersible vehicle. The wet submersible vehicle can accommodate one or more human occupants thereon, includes its own propulsion mechanism, or is designed to be towed by a towing means, for propelling the wet submersible vehicle through water, and includes a water-floodable gas reservoir that contains a gas and that is open to water ingress/egress. The suit is deformable and includes a main portion that defines a single common interior space that when donned by the human occupant envelops at least the head and neck of the user, and optionally envelopes the chest, lower abdomen, waist, upper thighs, shoulders, arms and hands of the human occupant. The single common interior space is open to water ingress/egress which permits water to be forced out of the interior space by gas introduced into the interior space, as well as allow entry of water into the suit when gas is transferred out of the interior space. A valved fluid line extends between the suit and the water-floodable gas reservoir that can be controllably opened and closed providing fluid communication between the suit and the water-floodable gas reservoir to exchange gas therebetween.

DRAWINGS

Figure 2A:
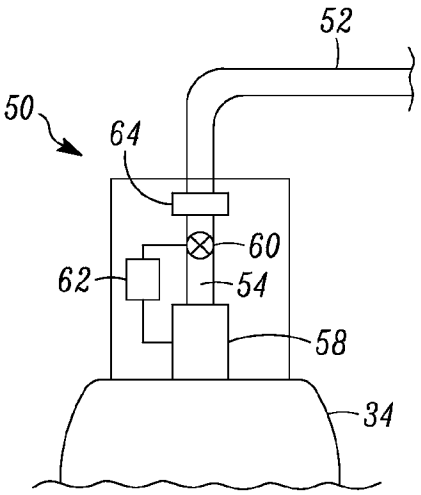
FIG. 2A illustrates details of one embodiment of a gas transfer mechanism described herein.
Figure 2:
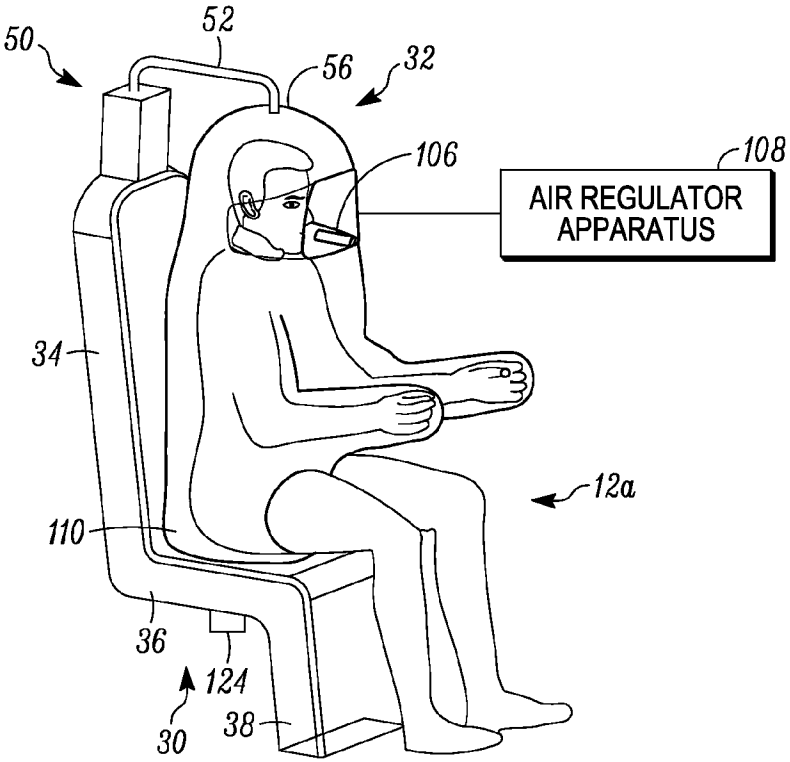
FIG. 2 illustrates a human occupant of the wet submersible vehicle in a seated position on a seat and wearing a suit described herein where the seat acts as a gas reservoir.
Figure 3C:
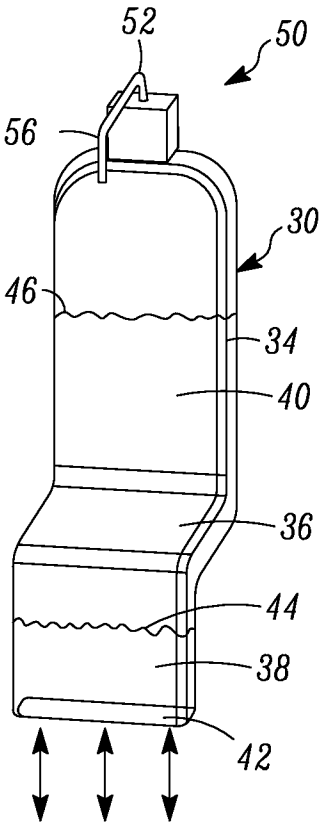
Figure 3B:
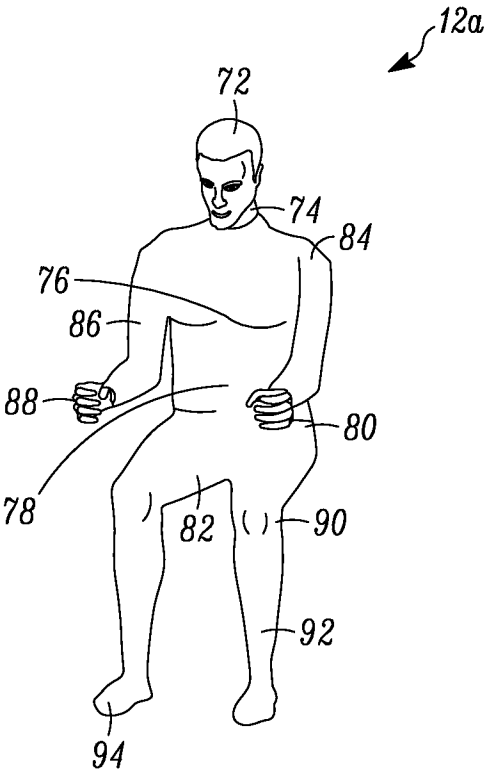
Figure 3A:
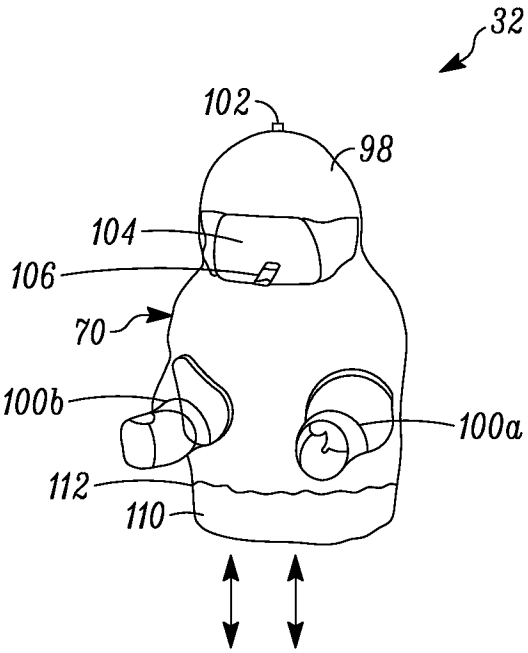

FIGS. 3A-C illustrate the suit, the occupant, and the seat, respectively, shown in FIG. 2.

Figure 4:
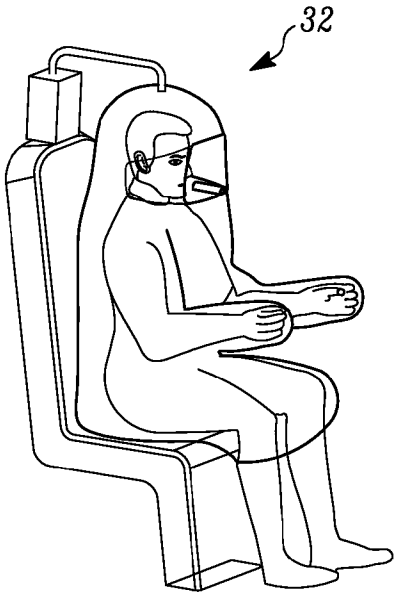

FIG. 4 is a view similar to FIG. 2 but with the suit extending down to cover the knees of the occupant.

Figure 5:
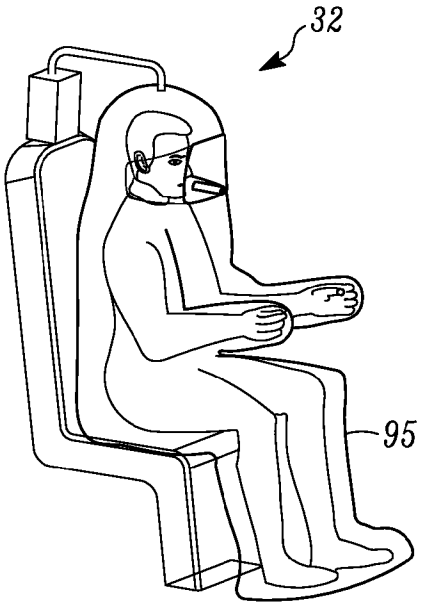

FIG. 5 is a view similar to FIG. 2 but with the suit extending down to cover the feet and the lower legs of the occupant which are in the same space.

Figure 6:
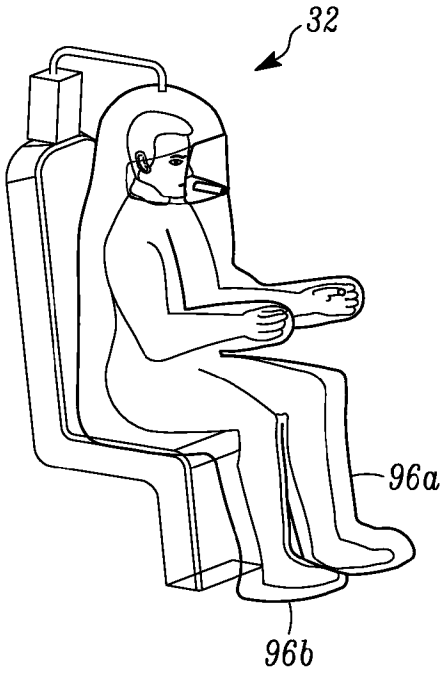

FIG. 6 is a view similar to FIG. 2 but with the suit extending down to cover the feet and the lower legs of the occupant which are in separate leg sleeves.

Figure 7:
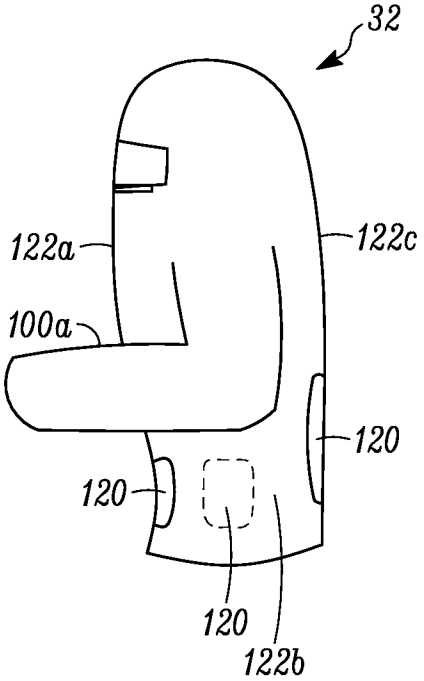

FIG. 7 is a side view of the suit showing example locations of an internal dry storage pouch formed inside the suit.

Figure 8:
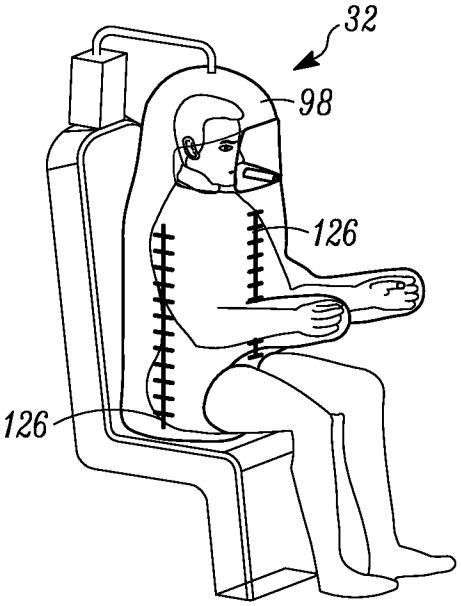

FIG. 8 is a perspective view of the suit showing example locations of a suit closure mechanism.

Figure 9:
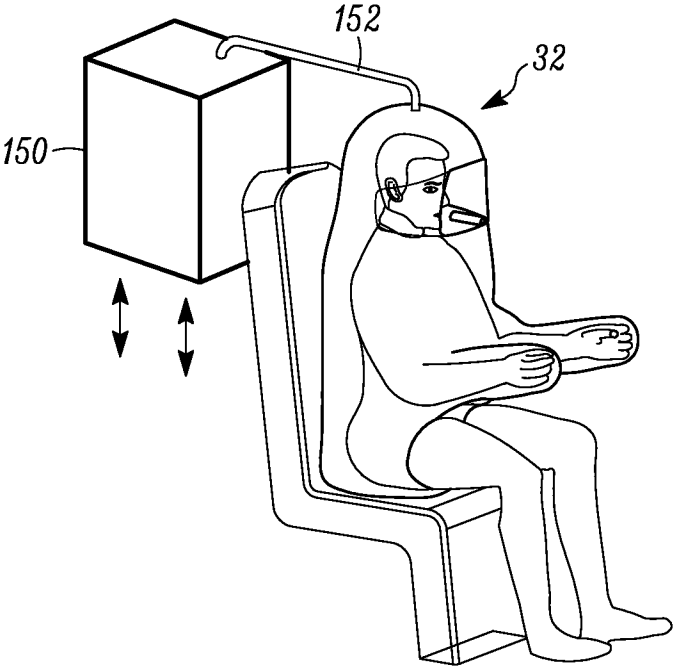

FIG. 9 is a view similar to FIG. 2 with a gas reservoir separate from the seat.

Figure 10:
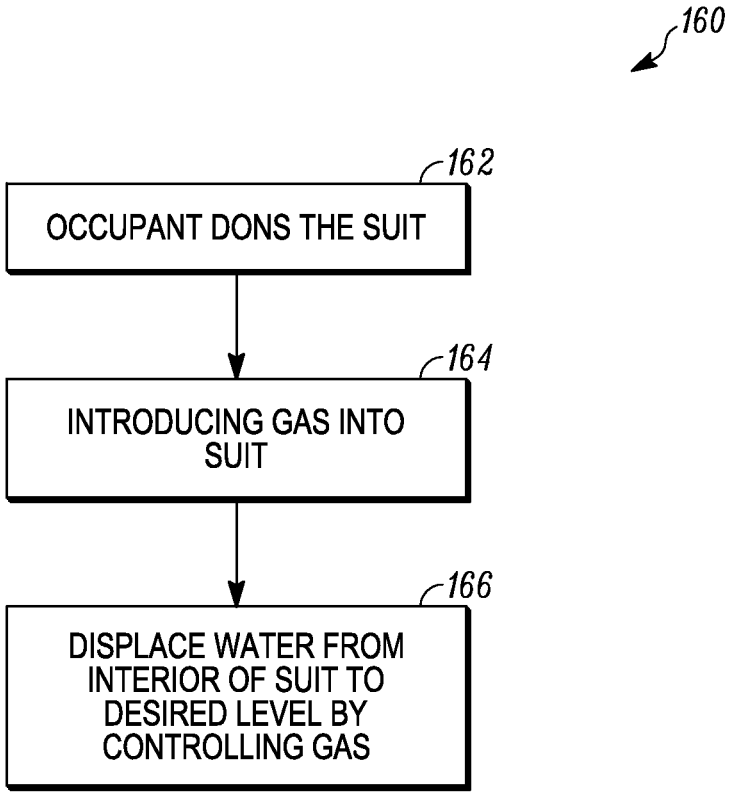

FIG. 10 illustrates example steps in one embodiment of a method of using the suit.

Figure 11:
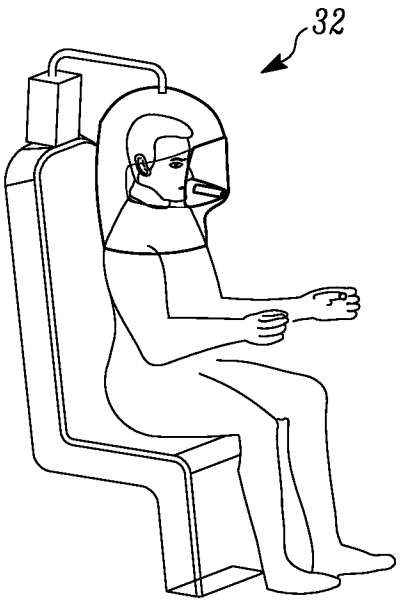

FIG. 11 is a view similar to FIG. 2 but with the suit extending down to cover the head and neck of the occupant.

DETAILED DESCRIPTION

A wet manned submersible vehicle or the like as used herein is intended to encompass any manned vehicle that can have its own on-board propulsion mechanism or that is intended to be towed by another vehicle, that is intended to operate underneath the water surface with one or more human operators or occupants riding on or in the vehicle. During normal operation, the occupants are exposed directly or indirectly to the combined ambient pressure and water environment while riding on or in the vehicle. This is in contrast to a dry manned submersible vehicle such as a submarine where the water is intended to be kept out of most portions of the vehicle and the human operators are not intended to be exposed directly or indirectly to the combined ambient pressure and water during typical operation. Examples of wet manned submersible vehicles include, but are not limited to, the SEAL Delivery Vehicle, British Mk 1 "chariot", the Pegasus swimmer propulsion device, and other diver assist vehicles such as those similar to the various underwater scooters once produced by Farallon USA.

The term gas as used herein is intended to refer to a material in a gaseous state. Examples of gases that can be used include, but are not limited to, air or inert gases such as nitrogen or argon, and are not necessary for inhalation or life support.

A water-floodable reservoir or water-floodable suit as used herein is intended to refer to a reservoir or suit that contains gas at the top and water beneath the gas separated by a free surface water/gas interface, and where additional water can automatically flood into the reservoir or suit in an amount that is proportional to the amount of gas that is transferred out of the reservoir or suit, and where water can be forced out of the reservoir or suit in an amount that is proportional to the amount of gas that is introduced into the reservoir or suit.

Figure 1A:
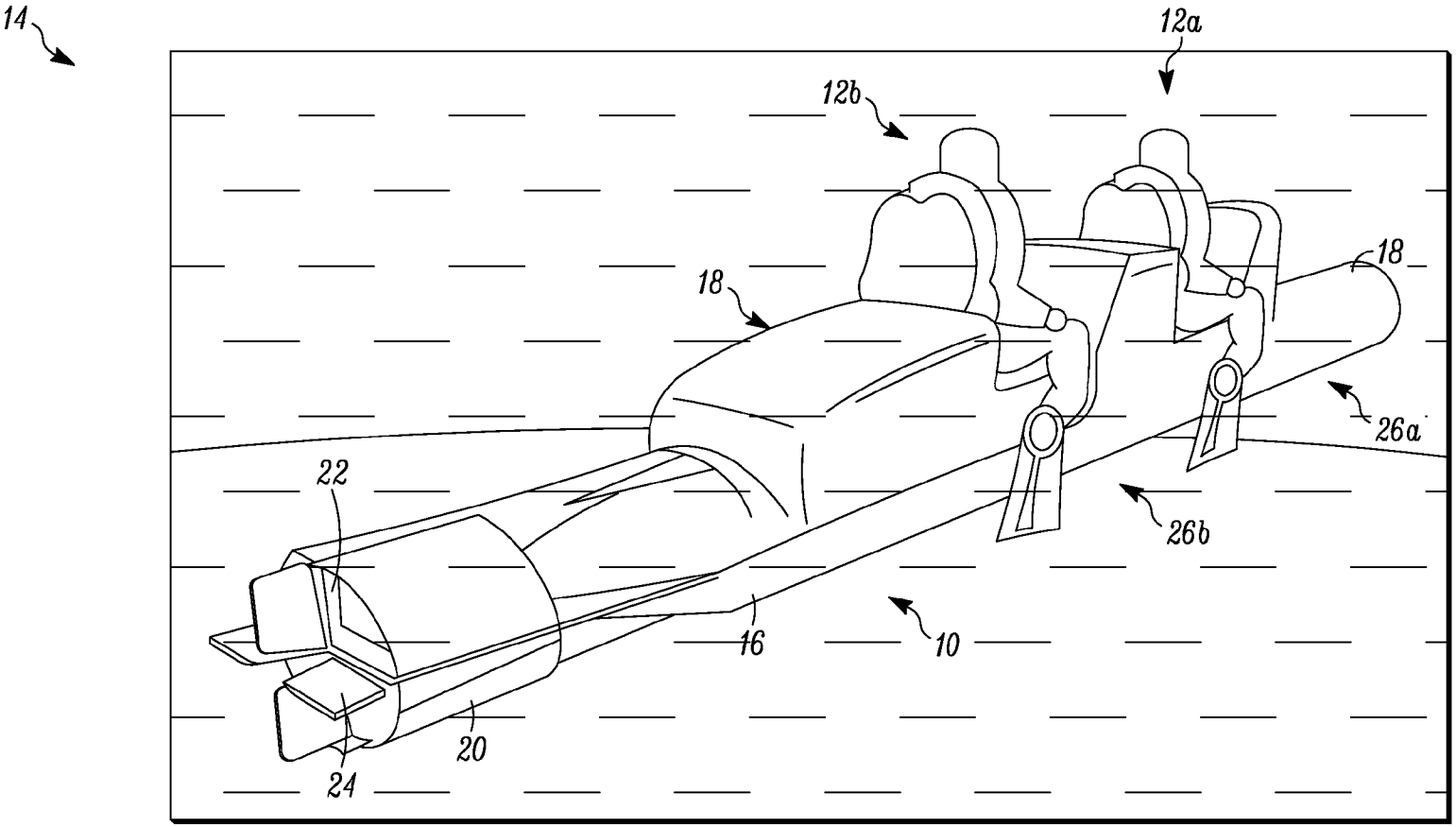
FIG. 1A illustrates an example of a wet manned submersible vehicle on which the suits described herein can be utilized.

FIG. 1A illustrates one example of a wet manned submersible vehicle 10 with which the concepts described herein can be utilized. In the illustrated example, the vehicle 10 is configured to be ridden by two human occupants 12*a*, 12*b* in a front and rear arrangement. When riding on the vehicle 10, the two occupants 12*a*, 12*b* are exposed to and in direct contact with the surrounding water 14 in which the vehicle 10 is submerged. Although two occupants 12*a*, 12*b* are illustrated, in other embodiments the vehicle 10 can include a single occupant or more than two occupants. In addition, in other embodiments, the occupant(s) can be positioned in a side-by-side arrangement as discussed below with respect to FIG. 1B or an over-under arrangement. The occupants 12*a*, 12*b* are illustrated in a seated position while riding on what is essentially the outside of the vehicle 10. However, in other embodiments, the occupant(s) could be partially or completely disposed within a flooded interior space of the vehicle while still being considered as exposed to the surrounding water as discussed below with respect to FIG. 1B.

Figure 1B:
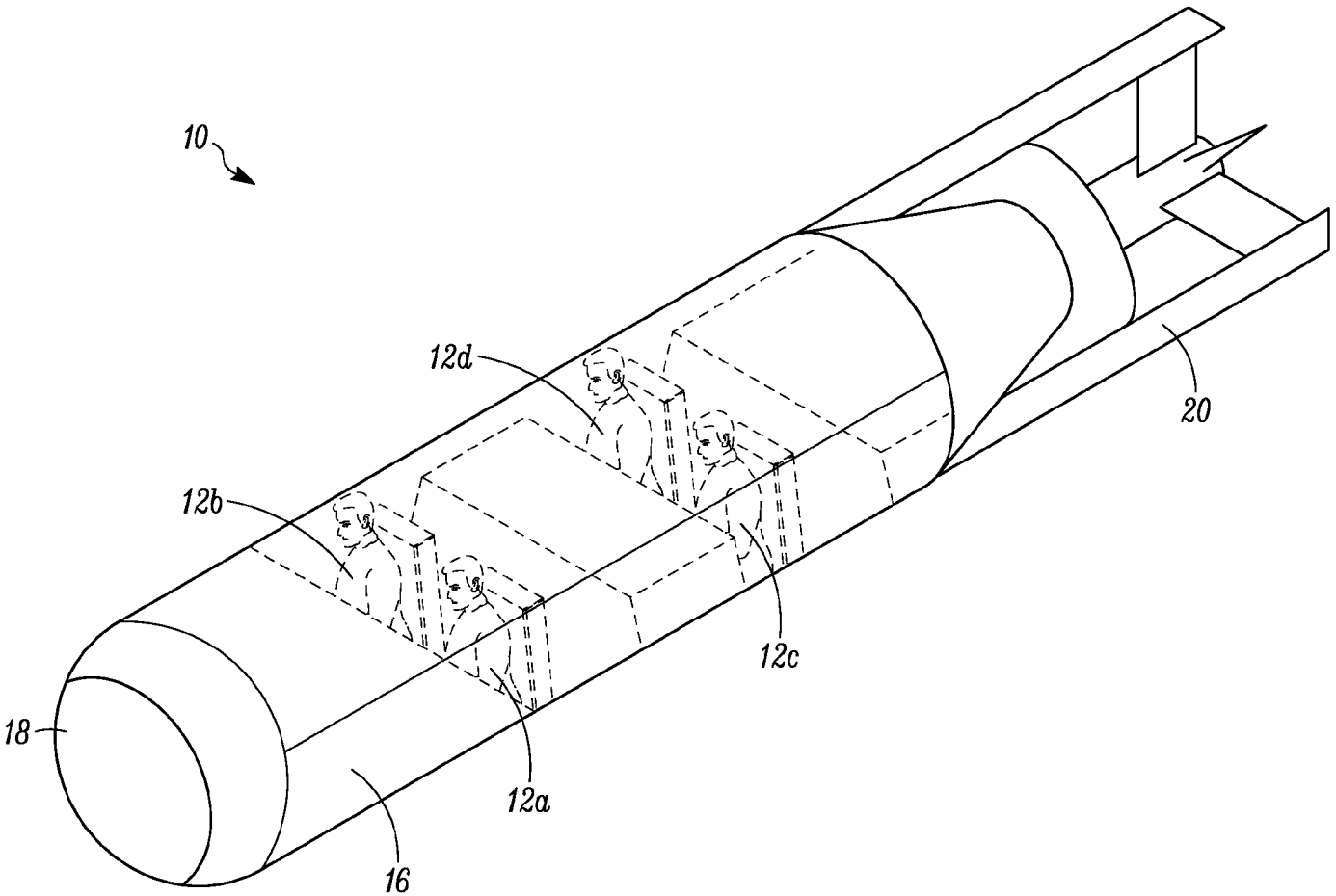
FIG. 1B illustrates another example of a wet manned submersible vehicle on which the suits described herein can be utilized.

FIG. 1B illustrates another embodiment of the vehicle 10 which is known as a SEAL Delivery Vehicle. In the vehicle 10, the occupants 12*a*, 12*b*, 12*c*, 12*d* are seated in a front and rear arrangement, with the front occupants 12*a*, 12*b* seated generally side-by-side and the rear occupants 12*c*, 12*d* seated generally side-by-side. The occupants 12*a-d* are seated so they are completely disposed within the vehicle 10, yet the vehicle 10 is open to the surrounding water so that the interior of the vehicle 10 where the occupants sit is flooded with water. In other embodiments of vehicles, the occupant(s) could ride in a generally prone position or a generally supine position in or on the vehicle. The embodiments illustrated in FIGS. 1A and 1B are examples only. Many other examples and variations of wet manned submersible vehicles are known and can be utilized.

In some embodiments, a vehicle may not even be used. Instead, a person that is submerged in water but not riding in or on a vehicle can also use one of the suits described below. So even though the following description describes use of the suits by occupants of a wet manned submersible vehicle, and the drawings illustrate wet manned submersible vehicles, the concepts described herein, including the suits described below, are not limited to use with wet manned submersible vehicles.

Referring to FIG. 1A (along with FIG. 1B), the vehicle 10 includes a vehicle body 16 with a front end 18 and a rear end 20. The vehicle body 16 is generally hydrodynamically shaped to facilitate efficient travel through the water 14. A propulsion mechanism 22 is provided, for example at the rear end 20, for propelling the vehicle 10, along with the occupants 12*a*, 12*b*, . . . n through the water 14. A suitable steering mechanism 24, such as one or more steerable fins, may also be provided for controllable maneuvering of the vehicle 10 through the water 14. In the illustrated example of FIG. 1A, the vehicle body 16 defines two occupant stations 26*a*, 26*b* at which the occupants 12*a*, 12*b* are positioned while riding the vehicle 10. In the illustrated example of FIG. 1B, the vehicle body 16 defines four or more occupant stations at which the occupants 12*a*, 12*b*, 12*c*, 12*d* are positioned while riding the vehicle 10.

With reference to FIG. 2, one of the human occupants 12*a* of the wet submersible vehicle 10 of FIG. 1A or FIG. 1B is illustrated in a seated position on a seat 30 that can be part of the wet submersible vehicle 10. The occupant 12*a* is wearing a flexible, deformable suit 32 described herein. In this embodiment, the seat 30 is configured to act as a gas reservoir that exchanges gas with an interior of the suit 32.

With reference to FIGS. 2 and 3C, in the illustrated embodiment, the seat 30 includes a back portion 34, a sitting portion 36, and a base portion 38. The back portion 34, the sitting portion 36, and the base portion 38 can be an integrally formed, one-piece construction constructed from a suitable material such as sealed wood, metal, a coated fabric, elastomer, or plastic. The seat 30 is partially or completely hollow so that the back portion 34, the sitting portion 36, and the base portion 38 define a water-floodable, hermetic gas reservoir 40 in the interior thereof. The size of the gas reservoir 40 formed in the seat 30 is sufficient to contain enough gas therein so that enough gas can be transferred into the suit 32 as discussed further below to force water from the interior of the suit 32 to form the pneumatic barrier around the occupant 12*a*. The seat 30 is also open to the surrounding water environment so that as gas is transferred from the gas reservoir 40 into the suit 32, a corresponding amount of water enters into the reservoir 40, and when gas is transferred from the suit 32 back into the reservoir 40, water is forced out of the reservoir 40 back into the surrounding water environment. Any means for allowing water ingress and egress into and from the reservoir 40 can be utilized. In the illustrated example, a bottom edge 42 of the base portion 38 is open to allow ingress and egress of water into and from the reservoir 40 as indicated by the arrows in FIG. 3C. Ingress and egress of water into and from the reservoir 40 can be achieved in any suitable manner including, but not limited to, using vents, drain tubes, scuppers, or the like.

FIG. 3C illustrates an example of a first condition of the seat 30 prior to transferring gas into the suit 32, where a first water/gas interface 44 is located in the base portion 38 so that the reservoir 40 contains a maximum amount of gas located above the interface 44 and a minimum amount of water below the interface 44. When gas is transferred from the reservoir 40 into the suit 32, the volume of gas is reduced and replaced with water which enters into the reservoir 40 through the ingress means, such as through the bottom edge 42, opening(s), vent(s), pipe(s), scupper(s), etc. An example of a second condition after the gas is transferred into the suit 32 is illustrated by a second water/gas interface 46 which in this example is shown as being located in the upper back portion 34 so that the reservoir 40 contains a minimal amount of gas located above the interface 46 and a maximum amount of water is present in the reservoir 40 below the interface 46. The first water/gas interface 44 can be located at a level that is just above the location(s) of the water ingress/egress means formed in the reservoir 40 through which water can enter and exit the reservoir 40.

Returning to FIGS. 2, 2A and 3C, a gas transfer mechanism 50 is provided at an elevation above the top of reservoir 40 and the suit 32 for transferring gas between the reservoir 40 and the suit 32. The gas transfer mechanism 50 includes a fluid line 52 that has a first end 54 that is in fluid communication with the reservoir 40, and a second end 56 that is connectable to the suit 32. The connections between the fluid line 52 and the reservoir 40 and the suit 32 can be, for example, at or near the upper-most regions of both. The gas transfer mechanism 50 further includes a pump 58 (FIG. 2A), for example a reversible pump, for pumping the gas in one or both directions through the fluid line 52 into and/or from the suit 32, and a valve 60 (FIG. 2A) that controls the gas flow through the fluid line 52. If either the reservoir 40 of the suit 32 are located at different elevations relative to one another, then a single direction pump 58 can be used to convey gas from the upper volume (i.e. whichever one of the reservoir 40 or the suit 32 is higher in elevation) to the lower volume (i.e. whichever one of the reservoir 40 or the suit 32 is lower in elevation). Both the pump 58 and the valve 60 can be controllable, for example via a control mechanism 62, and power can be provided by one or more batteries on the vehicle 10. Control commands to control the transfer of gas between the reservoir 40 and the suit 32 can be initiated by the occupant 12*a* using, for example, suitable controls on the vehicle 10. In some embodiments, the valve 60 can be manually opened and closed by the occupant 12, and the pump 58 can be manually driven by the occupant 12*a*, for example by rotating a handle or using the occupant's foot to actuate a bellows, diaphragm or the like. In some embodiments, the gas in the fluid line 52 can flow through and be heated by a powered heater 64 that mechanically/electrically/chemically warms the gas prior to delivery into the interior space of the suit 32.

With reference now to FIGS. 2, 3A, and 3B, the suit 32 is configured to be worn by the occupant 12*a*. The suit 32 is deformable and the material forming the suit 32 is designed to be both gas and water impermeable so that gas in the interior of the suit cannot escape through the material of the suit, and water in the surrounding water environment cannot permeate through the material of the suit into the interior. The suit 32 can be formed of any materials providing these properties. Examples of materials that can be used include, but are not limited to, materials used to form dry suits such as elastomeric coated fabrics or rigid geometric shapes interconnected with sealed hinge joints. The suit 32 is illustrated in FIGS. 2 and 3A in an "inflated" condition where gas has been introduced into the interior of the suit 32 from the reservoir 40. When the gas is transferred from the suit 32 back into the reservoir 40, the suit 32 would assume a collapsed or non-inflated configuration about the occupant 12*a*. The suit 32 is illustrated in the figures as being transparent to help in understanding the construction and operation of the suit. In actual practice, the suit 32 may be transparent, translucent or opaque.

In the example illustrated in FIGS. 2, 3A, and 3B, the suit 32 includes a main portion 70 that defines a single common interior space that when donned by the human occupant 12*a* envelops the head 72, neck 74, chest 76, lower abdomen 78, waist 80, upper thighs 82, shoulders 84, arms 86 and hands 88 of the human occupant 12*a* as shown in FIG. 2. In another embodiment, the suit 32 can be extended downward so that the single common interior space also envelopes the knees 90 of the occupant 12*a* as shown in FIG. 4. In still another embodiment, the suit 32 can be extended downward so that the single common interior space also envelopes the lower legs 92 and the feet 94 of the occupant 12*a*, with the lower legs 92 and feet 94 being side-by-side in a common space 95 as shown in FIG. 5. In still another embodiment, the suit 32 can be extended downward so that the single common interior space also envelopes the lower legs 92 and the feet 94 of the occupant 12*a*, with the lower legs 92 and feet 94 being disposed in separate left and right leg sleeves 96*a*, 96*b*, respectively, as shown in FIG. 6. The leg sleeves 96*a*, 96*b* are both in communication with and form part of the single common interior space. In still another embodiment illustrated in FIG. 11, the suit 32 extends downward so that the single common interior space envelopes the head 72, neck 74 and tops of the shoulders 84 of the human occupant 12*a*. Many other configurations of the suit 32 covering different portions of the occupant's 12*a* body are possible.

Returning to FIG. 3A, the main portion 70 of the suit 32 includes a head protuberance 98 in which the head 72 of the occupant 12*a* is disposed during use. The main portion 70 also includes a pair of arm and hand protuberances 100*a*, 100*b* into which the occupant's arms 86 and hands 88 can extend to permit the occupant 12*a* to access and control equipment and conduct activities external to the suit 32. In one embodiment, main portion 70 of the suit 32, and the interior space thereof, can be sized to permit the occupant to withdraw their arms 86 and hands 88 into the interior space so that the occupant can maneuver their arms and hands inside the interior space, for example to access other parts of their body using their hands 88. In the case of the embodiments illustrated in FIGS. 4-6, the occupant 12*a* may also be able to withdraw their legs (thighs, knees, lower legs) and feet into the interior space for access by the occupant's hands. In one non-limiting example, when "inflated", the interior space of the main portion 70 of the suit 32 illustrated in FIG. 3A can have an interior volume of about 8400 $in^3$.

The suit 32 further includes a fluid port 102 thereon that is connectable to the second end 56 of the fluid line 52, and through which gas is introduced into the interior space of the suit 32. In the example illustrated in FIG. 3A, the fluid port 102 is formed in the head protuberance 98 at the top of the suit 32. However, the fluid port 102 can be provided at any location on the suit 32 that can result in water being forced from the interior of the suit 32 when gas is introduced into the suit 32 through the fluid port 102 and where water will completely displace the gas from the interior volume of the suit 32 when gas is withdrawn from interior of the suit 32 via the fluid port 102. The head protuberance 98 further includes a transparent viewing panel 104 on a front side thereof that is positioned to permit the occupant 12*a* to see through the suit 32. The viewing panel 104 can be formed of a rigid plastic material such as polycarbonate, vinyl, or the like.

In one embodiment, a breathing portal 106 is formed in head protuberance 98 through which the occupant 12*a* breaths. In one non-limiting example, the breathing portal can be formed in the viewing panel 104, although other locations of the breathing portal 106 are possible. As shown in FIG. 2, the breathing portal 106 can be connected to an external air regulating apparatus 108 such as one or more SCUBA devices that provide a sanitary breathing gas mix (such as air) for the occupant 12*a*. In another embodiment where adequate recirculation of the gas in the interior space of the suit 32, including gas re-conditioning and removal of harmful constituents from the gas, can be provided, the occupant 12*a* may be able to breath the gas that is in the interior space of the suit 32, avoiding the need for the breathing portal 106 and the external air regulating apparatus 108.

Like the reservoir 40, the suit 32 is also water-floodable to allow ingress and egress of water into and from the interior space of the suit 32. Any means for allowing water entry and egress into and from the suit 32 can be utilized including, but not limited to, a scupper(s), standpipe(s) or tube(s), vent(s), louver(s), and the like. In the illustrated example of FIG. 3A, the main portion 70 of the suit 32 includes a skirt 110 that is open and through which water can enter and exit the interior space of the suit 32.

FIG. 3A illustrates an example of a first condition of the suit 32 prior to gas being introduced into the suit 32 (the suit 32 is shown inflated for sake of convenience even though gas may not have been introduced into the suit 32 to inflate the suit 32) as well as a second condition of the suit 32 after gas being introduced. In the first condition, the interior of the suit 32 may be entirely filled with water particularly if the suit 32 is donned by the occupant 12*a* while under water. In the first condition, the reservoir 40 contains a maximum amount of gas and a minimum amount of, or no, water as indicated by the gas/water interface 44 shown in FIG. 3C. When gas is transferred from the reservoir 40 into the suit 32, the gas forces water from the interior of the suit 32 out of the skirt 110. The occupant 12*a* can control how much gas is introduced into the suit 32 to determine the level of a resulting gas/water interface 112 in the suit as shown in FIG. 3A. The level of the gas/water interface 112 can be located at a level that is just above the water ingress/egress means of the suit 32.

To prevent the suit 32 from floating free when the interior space is filled with gas, the suit 32 can be fastened to the vehicle 10. For example, with reference to FIG. 2, the suit 32 can be fastened to the seat 30. In one embodiment, the skirt 110 of the suit 32 can be fastened to the sitting portion 36 and/or to the back portion 34 using buttons, snaps, hoop and loop fasteners, or other fastening means. In one embodiment, the suit 32 is detachably fastened to the vehicle 10, such as to the seat 30, to allow detachment of the suit 32 from the vehicle. In one embodiment, the fastening that is used is not continuous around the skirt 110; instead gaps or spaces can be provided between the fasteners to permit the ingress and egress of water through the skirt 110 between the spaced fasteners. In another embodiment, the suit 32 is fastened to the occupant 12*a*, for example to the occupant's thighs, instead of being fastened to the vehicle 10.

In some embodiments, when not in use the suit 32 may be stowed in a folded and compressed state in an accessible storage location, for example in a compartment 124 on or near the seat 30 (see FIG. 2 showing the compartment 124 underneath the seat 30). When the suit 32 is to be used, the suit 32 is removed from its storage location, unfolded and donned by the occupant 12*a* and fastened to the seat 30. The suit 32 can be accessed and donned by the occupant 12*a* at any time while occupant 12*a* is on the vehicle 10, for example while the vehicle 10 is at the surface of the water or submerged under the water. In another embodiment, the suit 32 can be donned by the occupant prior to the occupant occupying the vehicle 10, with the occupant then attaching the suit 32 to the fluid line 52 and fastening the suit to the vehicle 10 after occupying the vehicle.

FIG. 7 illustrates a variation of the suit 32 where the interior of the suit 32 is formed with one or more internal dry storage pouches 120, for example on an interior front surface 122*a*, on an interior side surface 122*b*, and/or on an interior rear surface 122*c* of the suit 32. The pouch 120 can be opened and closed, for example by a flap or a waterproof zipper, and forms a storage area allowing storage of items that the occupant 12*a* may want to access while within the suit 32. Because the pouch 120 can be closed in a water tight manner, the storage area and the contents contained therein can be kept dry even while the suit is flooded and folded prior to or after use. Once the occupant 12*a* introduces the gas into the interior of the suit 32 to force out the water to the desired level, typically below the level of the pouch 120, the occupant 12*a* can then withdraw one or both arms into the interior of the suit to open the pouch 120 and access contents within the pouch 120.

In some embodiments, the suit 32 may be simply pulled over the occupant 12*a* by the occupant 12*a* entering the suit 32 through the skirt 110. In other embodiments, the suit 32 can be opened and closed by one or more waterproof closure mechanisms that permit the main portion 70 of the suit 32 to be opened and closed to facilitate donning and removal of the suit 32 by the occupant 12*a*. For example, with reference to FIG. 8, the suit 32 can include a waterproof zipper 126 on a side of the main portion 70 and/or on the front of the main portion 70. The waterproof zipper 126 extends from the skirt 110 up toward the head protuberance 98 and can be designed to close in the upward or downward directions relative to the skirt 110. In other embodiments, the waterproof zipper 126 can extend circumferentially around the suit 32 instead of extending vertically on the suit. Waterproof closure mechanisms other than the waterproof zipper 126 can be used.

The embodiments described above describe the gas reservoir 40 as being formed by the seat 30. However, other gas reservoirs on the vehicle 10 in place of or in addition to the gas reservoir 40 in the seat 30 can be used. For example, FIG. 9 illustrates a water-floodable gas reservoir 150 that communicates with the fluid line 52 for exchanging gas with the interior of the suit 32. The reservoir 150 can be positioned at any location on the vehicle 10 where the reservoir 150 is exposed to or communicates with the surrounding water environment, and the reservoir includes drains, scuppers or other openings to permit ingress and egress of water from the reservoir 150 as indicated by the arrows in FIG. 9. The reservoir 150 functions similarly to the reservoir 40 and can also include a gas transfer mechanism similar in construction and function to the gas transfer mechanism 50 described above.

FIG. 10 illustrates an example method 160 of using the suit 32. In a first step 162, the occupant dons the suit 32. As explained above, the suit can be donned by the occupant prior to or after occupying the vehicle 10, as well as while the vehicle is at the water surface or submerged underwater. In some embodiments, the suit 32 can be pre-connected to the fluid line 52 prior to the occupant donning the suit 32 and/or the suit can be pre-attached to the vehicle 10. In other embodiments, after the occupant dons the suit 32, the occupant or another person connects the fluid port 102 of the suit 32 to the fluid line 52, and fastens the suit 32 to the vehicle 10, for example fastening the skirt 110 to the seat 30.

Once the suit 32 is donned, the gas connection is established, and the suit 32 fastened to the vehicle 10, the occupant introduces gas from the gas reservoir into the interior of the suit 32 in step 164. The introduction of the gas can be initiated and controlled by the occupant in any manner, for example using an automated control located on the vehicle 10 or manually by the occupant. When gas introduction is initiated, the valve 60 is opened, automatically or manually, and the pump 58 pumps the gas, automatically and/or manually, from the reservoir into the interior of the suit 32 at an elevated pressure. Depending upon the relative elevations of the suit 32 and the reservoir, the gas in the reservoir may already be at a high enough pressure to flow into the suit 32 without use of the pump 58.

As gas is introduced into the suit 32, water is forced from the interior of the suit 32 out through the skirt 110. At the same time, the water level in the reservoir rises to replace the gas that has been transferred into the suit 32. In step 166, the occupant controls the amount of gas introduced into the suit which controls the level of the water/gas interface 112 in the suit 32 allowing the occupant to control how much water is forced from the interior of the suit 32.

The gas in the interior of the suit creates a pneumatic barrier around the occupant. The gas is heated by the occupant's body heat, and if additional heating is desired, the gas can also be heated by the heater 64. High heat loss from the occupant is reduced by enveloping at least the occupant's core in the gas barrier to isolate the occupant's core from the surrounding water while being transported on the vehicle 10.

Once the vehicle reaches a desired destination, the occupant can then pump the gas from the interior of the suit back into the reservoir, forcing the water from the interior of the reservoir and allowing water to flood into the suit. Because the total volume of gas in the reservoir and the interior of the suit, for any given depth, remains constant, the overall buoyancy acting on the wet submersible vehicle does not change for any given depth. In addition, because the gas is re-useable, the gas does not require regeneration. In addition, there is no expelled gas that is prone to observation resulting from a tell-tale eruption of bubbles at the water surface.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A system, comprising:

a water-floodable gas reservoir that contains a gas and that is open to water;

a suit configured to be worn by a human, the suit is deformable and includes a main portion that defines a single common interior space that is configured to envelope at least the head and neck of the human, and the single common interior space being open to water;

a fluid line extending between the suit and the water-floodable gas reservoir that can place the single common interior space in fluid communication with the water-floodable gas reservoir to exchange gas therebetween; and a valve that controls the flow of gas through the fluid line between the single common interior space and the water-floodable gas reservoir.

2. The system of claim 1, wherein the single common interior space of the main portion is further configured to envelope the chest, lower abdomen, waist, upper thighs, shoulders, arms and hands of the human.

3. The system of claim 2, wherein the single common interior space of the main portion is further configured to envelope the knees of the human occupant.

4. The system of claim 3, wherein the single common interior space of the main portion is further configured to envelope the lower legs and feet of the human occupant.

5. The system of claim 1, wherein the system further includes a wet submersible vehicle that is configured to accommodate the human, the wet submersible vehicle includes a propulsion mechanism that is configured to propel the wet submersible vehicle through water; the water-floodable gas reservoir is on the wet submersible vehicle; and the suit is fastened to the wet submersible vehicle.

6. A system, comprising:

a water-floodable gas reservoir that contains a gas and that is open to water;

a suit configured to be worn by a human, the suit is deformable and includes a main portion that defines a single common interior space that is configured to envelope at least the head and neck of the human, and the single common interior space being open to water;

a fluid line extending between the suit and the water-floodable gas reservoir that can place the single common interior space in fluid communication with the water-floodable gas reservoir to exchange gas therebetween;

a valve that controls the flow of gas through the fluid line between the single common interior space and the water-floodable gas reservoir;

a wet submersible vehicle that is configured to accommodate the human, the wet submersible vehicle includes a propulsion mechanism that is configured to propel the wet submersible vehicle through water; and the wet submersible vehicle includes a seat that is configured to seat the human, the seat defines the water-floodable gas reservoir, and the suit is fastened to the seat.

7. The system of claim 1, wherein the total volume of gas contained in the water-floodable gas reservoir and contained in the single common interior space remains constant for a given depth.

8. The system of claim 1, further comprising a pump in the fluid line that pumps gas between the water-floodable gas reservoir and the single common interior space of the suit.

9. The system of claim 1, wherein the gas comprises air or an inert gas.

10. The system of claim 1, further comprising a breathing portal formed in the suit that is connected to a breathing gas-regulator, the breathing portal is configured to permit the human occupant to breath via the breathing gas-regulator.

11. The system of claim 9, wherein the main portion of the suit includes a transparent viewing panel on a front side thereof that is positioned on the suit to permit the human to see through the suit.

12. The system of claim 1, wherein the suit further includes a closable storage area formed on an interior surface thereof.

13. The system of claim 1, wherein the main portion of the suit includes a waterproof closure mechanism that permits the main portion of the suit to be opened and closed.

14. The system of claim 13, wherein the waterproof closure mechanism is configured to be accessible by the human from within the single common interior space of the suit to permit the human to open and close the suit from inside the single common interior space.

15. The system of claim 1, further comprising a mechanical heater in communication with the fluid line that mechanically warms the gas.

16. The system of claim 1, wherein the suit includes an opening therein located beneath the main portion that places the single common interior space in communication with water.

17. The system of claim 16, wherein the opening comprises a skirt.

* * * * *